US008254618B2

(12) United States Patent
Babasaki

(10) Patent No.: US 8,254,618 B2
(45) Date of Patent: Aug. 28, 2012

(54) MICROPHONE

(75) Inventor: Shuichi Babasaki, Osaka (JP)

(73) Assignee: Icom Incorporated, Osaka (JP)

( * ) Notice: Subject to any disclaimer, the term of this patent is extended or adjusted under 35 U.S.C. 154(b) by 508 days.

(21) Appl. No.: 12/577,280

(22) Filed: Oct. 12, 2009

(65) Prior Publication Data

US 2010/0098283 A1 Apr. 22, 2010

(30) Foreign Application Priority Data

Oct. 17, 2008 (JP) ..... 2008-268352
Sep. 14, 2009 (JP) ..... 2009-211633

(51) Int. Cl.
*H04R 9/08* (2006.01)
*H04R 11/04* (2006.01)
*H04R 17/02* (2006.01)
*H04R 19/04* (2006.01)
*H04R 21/02* (2006.01)

(52) U.S. Cl. ..... 381/361; 381/366

(58) Field of Classification Search ..... 381/361, 381/355, 365, 366; 379/428.01, 433.01, 379/441, 447, 449, 450, 454, 455
See application file for complete search history.

(56) References Cited

U.S. PATENT DOCUMENTS 4,088,848 A * 5/1978 Weed ..... 248/314
5,806,146 A * 9/1998 Chen ..... 24/3.11
2009/0220117 A1* 9/2009 Inaoka et al. ..... 381/361

FOREIGN PATENT DOCUMENTS

JP 2001-160993 6/2001
JP 2003-224897 8/2003

* cited by examiner

*Primary Examiner* — Tuan Nguyen
(74) *Attorney, Agent, or Firm* — Baker & McKenzie LLP

(57) ABSTRACT

A microphone which does not need a hanger plate structure is provided. A conductive hanger knob is provided at the back of the rear case of a microphone case. The hanger knob has three layers of a conductive shaft part, an insulator part and a conductive bolt part in the named order from its center. The shaft part is electrically insulated from the bolt part. A notch that locks the bolt part of the hanger knob at a hanger surface is formed at a conductive hanger hook on which the microphone is hooked via the hanger knob. A support spring portion disposed at the back of the hanger surface urges the shaft part of the hanger knob locked at the notch in a direction of pushing the shaft part back toward the hanger surface. This provides electric conduction between the shaft part and the bolt part via the hanger hook.

17 Claims, 5 Drawing Sheets

$R_1:R_2 \neq R_3:R_4$

MICROPHONE

RELATED APPLICATIONS

This application is based on Japanese Patent Application No. 2008-268352 filed on Oct. 17, 2008 and Japanese Patent Application No. 2009-211633, and including specification, claims, drawings and summary. The disclosure of the above Japanese Patent Applications is incorporated herein by reference in its entirety.

FIELD OF THE INVENTION

The present invention relates to a microphone provided at a communicating apparatus.

DESCRIPTION OF THE RELATED ART

The ON/OFF mode of a communicating apparatus is changed over between a case where a microphone is hooked on a hanger hook and a case where the microphone is off-hooked therefrom. One hanger switch for detecting if a microphone is hooked on a hanger hook includes a microphone to which a printed circuit board for detection and a conductive hanger knob are mounted, and a metal hanger hook connected to the ground. Such a hanger switch detects the microphone being hooked on the hanger hook as the printed circuit board is electrically connected to the hanger hook via the hanger knob.

According to the hanger switch for the microphone, wiring extending from the hanger hook to connect the hanger hook to the ground interferes with the operation of the hanger switch. In addition, the hanger hook involves a troublesome work of setting the wiring. In this respect, a hanger switch has been proposed which eliminates the need for the wiring to avoid the interference of such wiring and the troublesome work of setting the wiring at the time of mounting the hanger hook.

For example, Unexamined Japanese Patent Application KOKAI Publication No. 2003-224897 describes a hanger switch for a microphone, which establishes electrical connection of the first contact of a printed circuit board to a hanger plate by means of a spring pin which presses the first contact and establishes electrical connection of the second contact of the printed circuit board to a hanger knob by means of a plate spring which presses the second contact. This configuration eliminates the soldering process at the time of assembling the microphone, and can completely isolate the rear case from the front case at the time of maintenance.

Further, Unexamined Japanese Patent Application KOKAI Publication No. 2003-224897 also describes that the hanger plate includes hanger springs having elastic pressing portions with spherical surfaces protrusively formed at approximately cross-shaped arms, respectively, and a hanger plate body for protecting the microphone from shocks. According to the hanger plate, when the microphone is hooked on the hanger hook, at least two of the contact points provided at four locations on the hanger plate contact the hanger hook. This improves the mounting feeling and durability at the time of hooking the hanger knob on the hanger hook.

Unexamined Japanese Patent Application KOKAI Publication No. 2001-160993 describes a hanger switch for a microphone, which is provided with a spring plate protrusively provided on the top surface of the hanger plate. This enhances the fixation at the time of hooking the microphone on the metal engagement portion provided at an automobile or the like, and suppressing the risk that sudden vibration would cause the microphone to be disengaged from the engagement portion.

SUMMARY OF THE INVENTION

However, both of the hanger switches for a microphone proposed in Unexamined Japanese Patent Application KOKAI Publication No. 2003-224897 and Unexamined Japanese Patent Application KOKAI Publication No. 2001-160993 detect the hooking of the microphone as the hanger plate and hanger knob are made to be electrically conductive with each other via the hanger hook. Those hanger plates have complex shapes. Particularly, the hanger plate disclosed in Unexamined Japanese Patent Application KOKAI Publication No. 2003-224897 is configured to be a 2-part component, making the dies to be used in producing the hanger plate expensive. Further, the formation of a projection, such as an elastic pressing part or a spring plate, at the hanger plate brings about issues of having awkward feeling when the user holds the microphone with a hand, and restrictions on the design of the microphone.

The present invention has been made in consideration of the above situations, and it is an object of the invention to provide a microphone which does not need a hanger plate structure.

To achieve the object, a microphone according to the invention includes a microphone case, a hanger knob secured to the microphone case, and a conductive hanger hook on which the microphone case is hooked via the hanger knob, the hanger knob having a first conductor portion extending in an extension direction of the hanger knob, and a second conductor portion insulated from the first conductor portion, wherein the hanger hook having a hanger member that is formed with a notch to lock the hanger knob and is in contact with the second conductor portion in a locked state, and an urging member that is in contact with the first conductor portion and urges the hanger knob in a direction of pushing the hanger knob back toward the hanger member, with the hanger knob being locked with the notch.

It is preferable that the urging member include a conductive plate spring.

Further, a recess may be formed at that portion of the first conductor portion which contacts the urging member, and a projecting portion that fits in the recess may be formed at the plate spring.

Furthermore, the second conductor portion may include a through hole formed in a direction of a center axis, a screw groove formed on one end portion of the second conductor portion which is secured to the microphone case, and a bolt that is screwed into a nut, provided inside the microphone case, to be secured to the microphone case, and the first conductor portion may extend inside the through hole through an insulator.

Moreover, the microphone may further include a printed circuit board provided inside the microphone case, a first conductive member that provides electrical conduction between the first conductor portion and a first contact on the printed circuit board, and a second conductive member that provides electrical conduction between the second conductor portion and a second contact on the printed circuit board.

It is preferable that the printed circuit board should have a detector that determines whether or not the microphone is hooked on the hanger hook, based on a voltage at the first contact and a voltage at the second contact.

Further, the first conductive member may include a conductive rubber that is insulated from the second conductor portion, have conduction with the first conductor portion, and may be disposed at one end of the first conductor portion which faces the printed circuit board, the rubber being in contact with the first contact of the printed circuit board.

Furthermore, the second conductive member may include a conductive plate spring that has one end secured to be conductive with the second conductor portion, and another end contacting the second contact of the printed circuit board.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A microphone according to an embodiment of the present invention and a hanger hook for the microphone will be described below with reference to the accompanying drawings.

Figure 1:
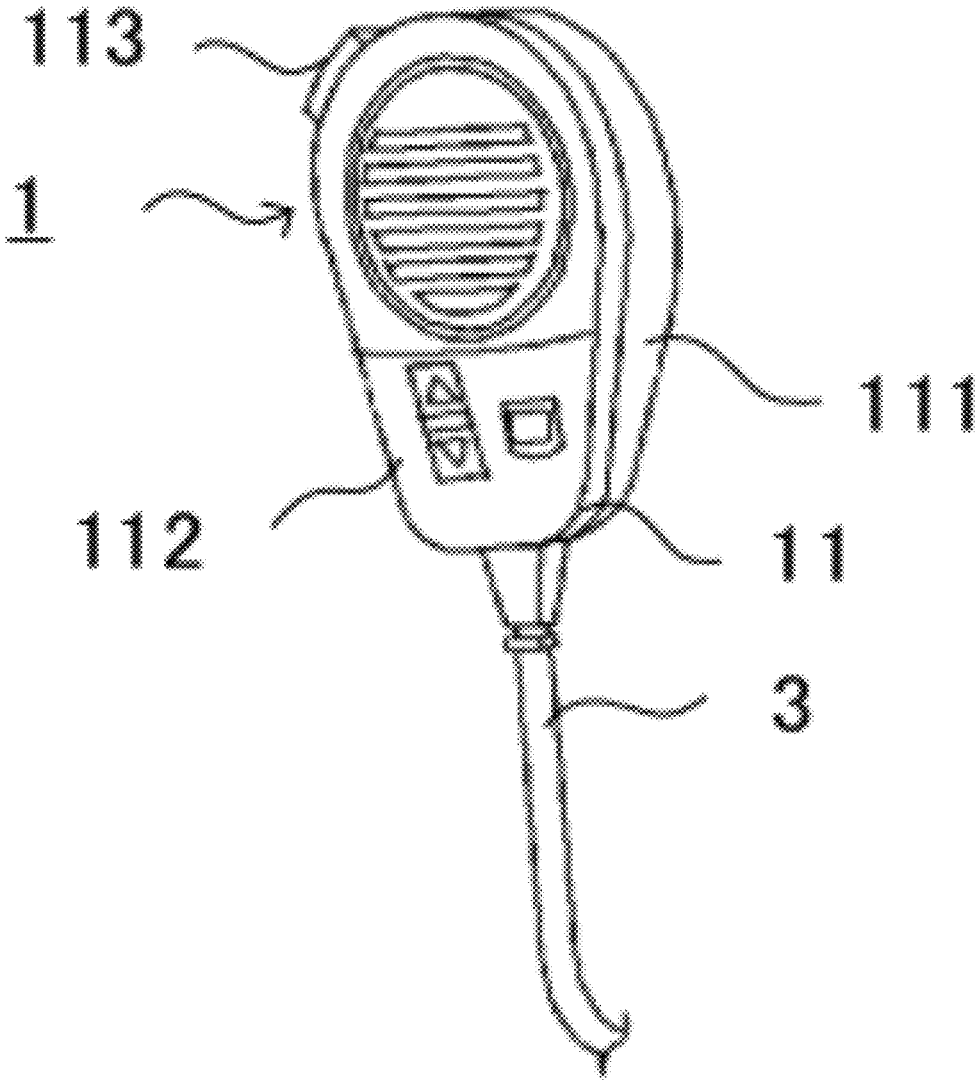
FIG. 1 is a perspective view showing a microphone according to an embodiment of the present invention.

FIG. 1 is a perspective view showing a microphone 1 according to the embodiment of the invention. As shown in FIG. 1, the microphone 1 is connected to the body of a communicating apparatus by a cord 3. Transmission is enabled by pressing a press-to-talk switch 113 provided on the side surface of a microphone case 11 having a front case 112 and a rear case 111.

Figure 2A:
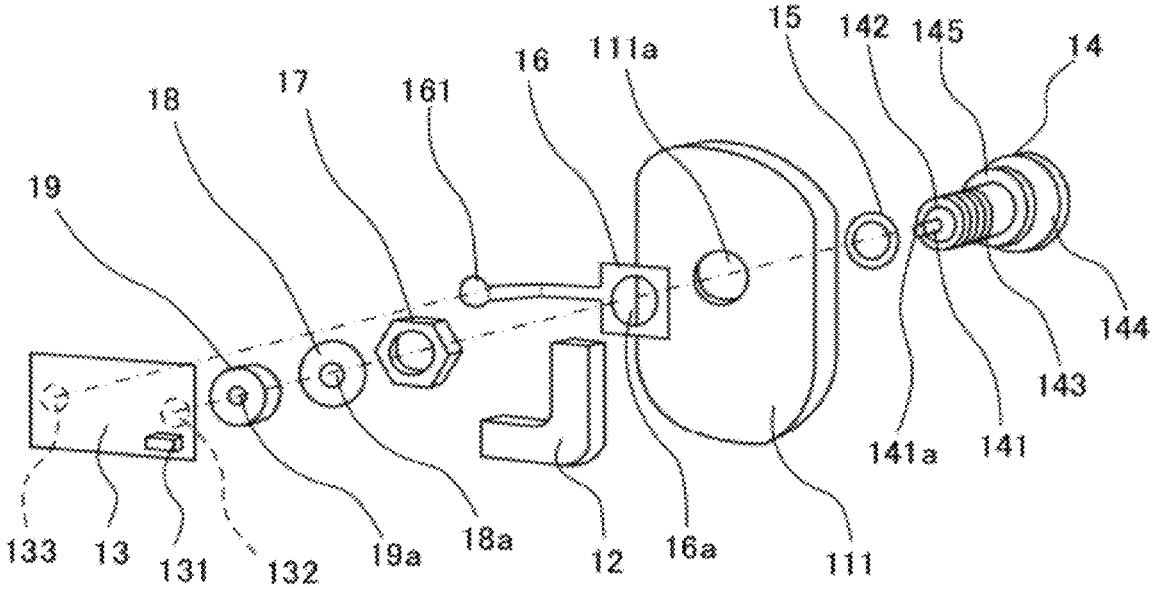
FIG. 2A is an exploded perspective view showing the configuration of the microphone according to the embodiment.

FIG. 2A is an exploded perspective view showing the configuration of the microphone 1 according to the embodiment.

As shown in FIG. 2A, the microphone 1 with the front case 112 removed therefrom includes the rear case 111, a weight 12, a printed circuit board 13, a hanger knob 14, an O ring 15, a plate spring 16, a nut 17, an insulating sheet 18, and a conductive rubber 19.

The rear case 111 is made of a non-conductive material and has a hole 111*a* having two steps formed at the edge. The O ring 15 and a second flange portion 145 of the hanger knob 14 to be described later are locked at the steps formed at the edge of the hole 111*a* at the time the hanger knob 14 fitted in the O ring 15 is inserted in the hole 111*a* from the back face of the rear case 111.

The weight 12 is formed by a metal plate. The weight 12, provided to give a weight to the microphone 1, is attached to the front face of the rear case 111.

The printed circuit board 13 is mounted to the rear case 111 with the weight 12 in between. The printed circuit board 13 is connected with a connector 131 which is used to supply the voltage from outside and transmit a signal from the microphone 1. A first contact 132 and second contact 133 which constitute a part of a circuit for a hanger switch are formed by a solder film or the like at the rear surface of the printed circuit board 13.

The hanger knob 14 has a shaft part 141, an insulator part 142, a bolt part 143, a first flange portion 144, and a second flange portion 145. The shaft part 141 is formed of a conductor, and is positioned at the center axis of the hanger knob 14. A projecting portion 141*a* protruding from the front face of the hanger knob 14 is formed at one end of the shaft part 141 which faces the printed circuit board 13. This projecting portion 141*a* is fitted into a hole 19*a* formed in a conductive rubber 19 to be described later. A recess 141*b* in which a projection 24*a* of a support spring 24 of the hanger hook 2 to be described later is to be fitted is formed in the other end of the shaft part 141. The insulator part 142 is formed of a non-conductor. As the insulator part 142 is formed so as to cover the shaft part 141, the shaft part 141 and the bolt part 143 are electrically insulated from each other. The bolt part 143 is formed of a conductor so as to cover the insulator part 142. A screw groove is formed on one end portion of the bolt part 143, while a first flange portion 144 and a second flange portion 145 are formed at the other end portion thereof. That face of the first flange portion 144 which faces the rear case 111 will come into contact with a hanger surface 23 of the hanger hook 2 to be described later, when the microphone 1 is hooked on the hanger hook 2. The second flange portion 145 is locked at the steps formed at the edge of the hole 111*a* when the hanger knob 14 is inserted in the hole 111*a* from the back face of the rear case 111. Further, as the bolt part 143 having the screw groove formed thereon is screwed into the nut 17 inside the microphone 1, the hanger knob 14 is secured to the rear case 111.

The O ring 15, formed of a rubber material, prevents water or the like from entering the microphone 1 from a clearance between the hanger knob 14 and the hole 111*a*. The O ring 15 is locked at the steps formed at the edge of the hole 111*a* of the rear case 111, with the bolt part 143 of the hanger knob 14 being inserted in the O ring 15.

The plate spring 16, made of a metal, has a hole 16*a* in which the bolt part 143 of the hanger knob 14 is to be inserted. The plate spring 16 is held and secured between the rear case 111 and the nut 17 with the bolt part 143 being inserted into the hole 16*a*, at the time of fastening the bolt part 143 and the nut 17 together. A contact-pressing arm portion 161 bent in the shape of an angled bracket ("<") is formed at the plate spring 16. An end portion of the arm portion 161 presses the second contact 133 of the printed circuit board 13 mounted to the rear case 111. This provides electric conduction between the second contact 133 and the bolt part 143 via the plate spring 16.

The nut 17 is made of a metal. As the nut 17 is fastened onto the bolt part 143 of the hanger knob 14 which is inserted into the hole 111*a* of the rear case 111, from the front side of the rear case 111, the hanger knob 14 is secured to the rear case 111.

The insulating sheet 18, made of a non-conductive material, has a hole 18*a* in its center for insertion of the projecting portion 141*a* of the shaft part 141 of the hanger knob 14.

The conductive rubber 19, formed of a conductive rubber material, has a hole 19*a* in its center in which the projecting portion 141*a* of the shaft part 141 of the hanger knob 14 is to be fitted. As the projecting portion 141*a* inserted through the insulating sheet 18 is fitted in the hole 19*a*, the conductive rubber 19 is attached to the shaft part 141 in such a state as to be electrically insulated from the bolt part 143. That face of the conductive rubber 19 which faces the printed circuit board 13 presses the first contact 132 of the printed circuit board 13 which is mounted to the rear case 111. Accordingly, the first contact 132 and the shaft part 141 have electric conduction therebetween via the conductive rubber 19.

Figure 2B:
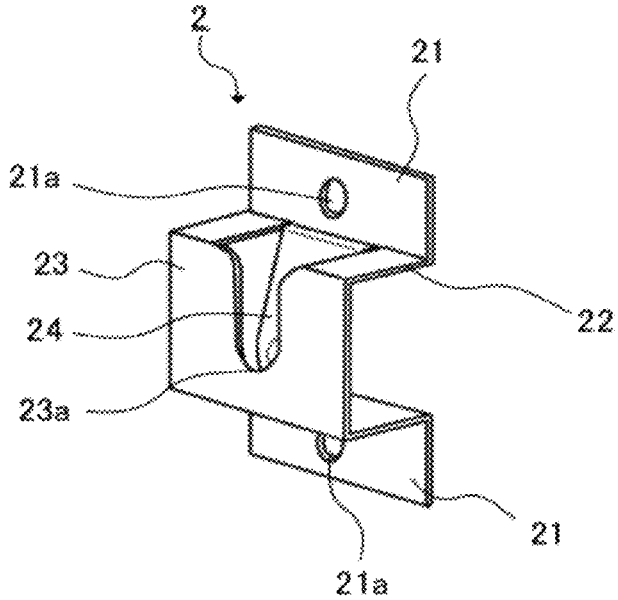
FIG. 2B is a perspective view showing a hanger hook according to the embodiment.
Figure 3:
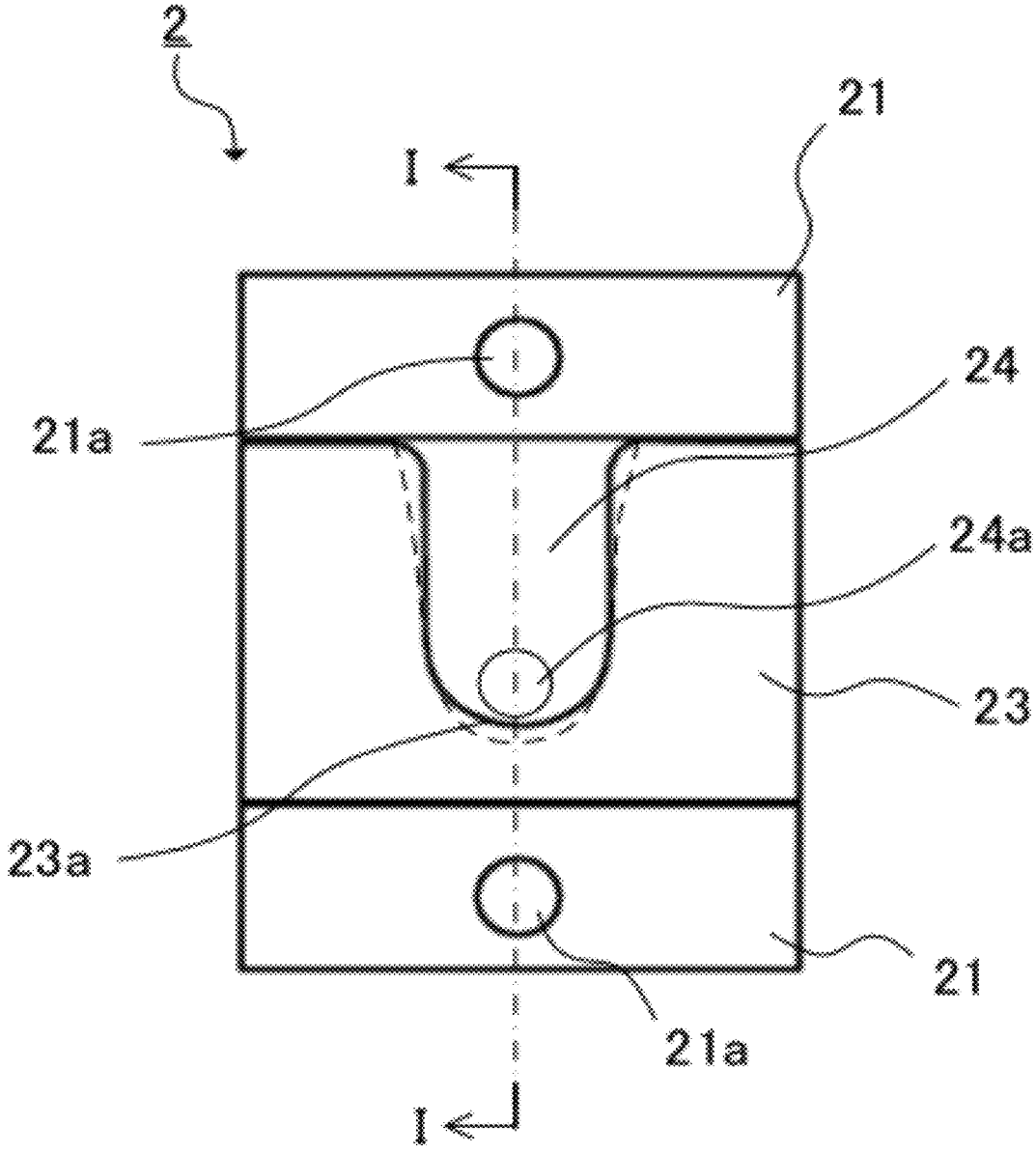
FIG. 3 is a front view showing the hanger hook according to the embodiment.

FIG. 2B is a perspective view showing the hanger hook 2, which is made of a conductive material. FIG. 3 is a front view of the hanger hook 2. The hanger hook 2 has two fixed surfaces 21 for fixing the hanger hook 2, a projecting surface 22 provided between the two fixed surfaces 21 and protruding in the cross-sectional shape of an approximately square bracket ("]") with respect to the fixed surfaces 21, and a support spring 24. Each of the two fixed surfaces 21 has a hole 21*a* to be used to fix the hanger hook 2. A U-shaped notch 23*a* is formed in the projecting surface 22, extending from the fixed surface 21 to the hanger surface 23 protruding therefrom. The support spring 24 extends from the fixed surface 21 toward the hanger surface 23. A projection 24*a* to be fitted in the recess 141*b* of the shaft part 141 is formed at the distal end of the support spring 24.

Figure 4:
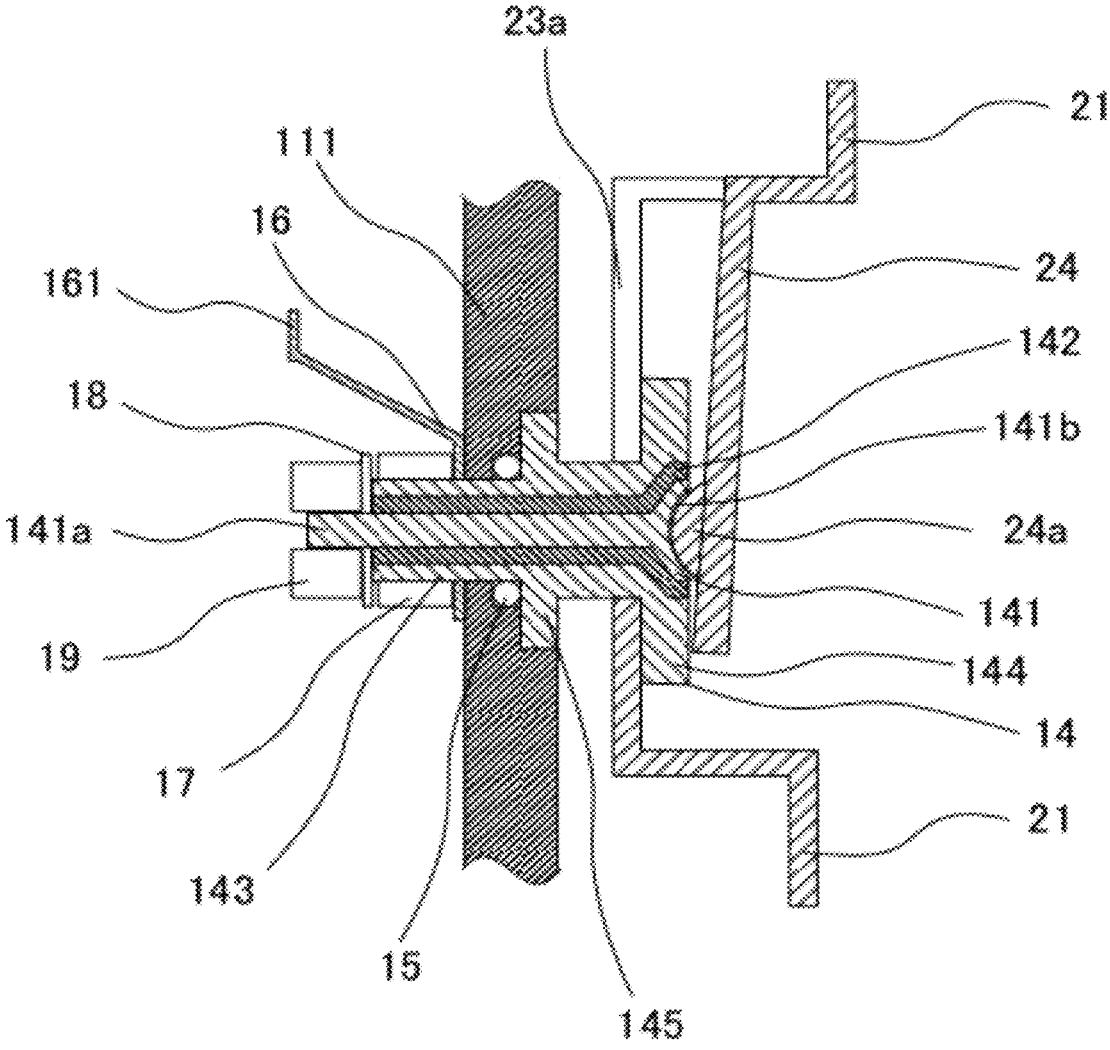
FIG. 4 is a schematic cross-sectional view of the essential portions along cut line I-I in FIG. 3 when the microphone according to the embodiment is hooked on the hanger hook.

FIG. 4 is a schematic cross-sectional view of the essential portions along cut line I-I in FIG. 3 when the microphone 1 is hooked on the hanger hook 2. As shown in FIG. 4, the hanger knob 14 provided at the rear surface of the microphone 1 is inserted in the notch 23*a*, and the first flange portion 144 is hooked at the lowermost end of the notch 23*a*. Then, the microphone 1 is hooked firmly with the repulsive force of the support spring 24 and the fitting of the projection 24*a* at the distal end of the support spring 24 in the recess 141*b* provided in the shaft part 141.

The operation of the hanger switch of the microphone 1 according to the embodiment will be described below. With the microphone 1 hooked on the hanger hook 2, the support spring 24 contacts the shaft part 141, causing the shaft part 141 of the hanger knob 14 to be conductive with the bolt part 143 via the hanger hook 2. The printed circuit board 13 is electrically conductive with the shaft part 141 via the conductive rubber 19. Further, the printed circuit board 13 is conductive with the bolt part 143 via the plate spring 16.

Figure 5:
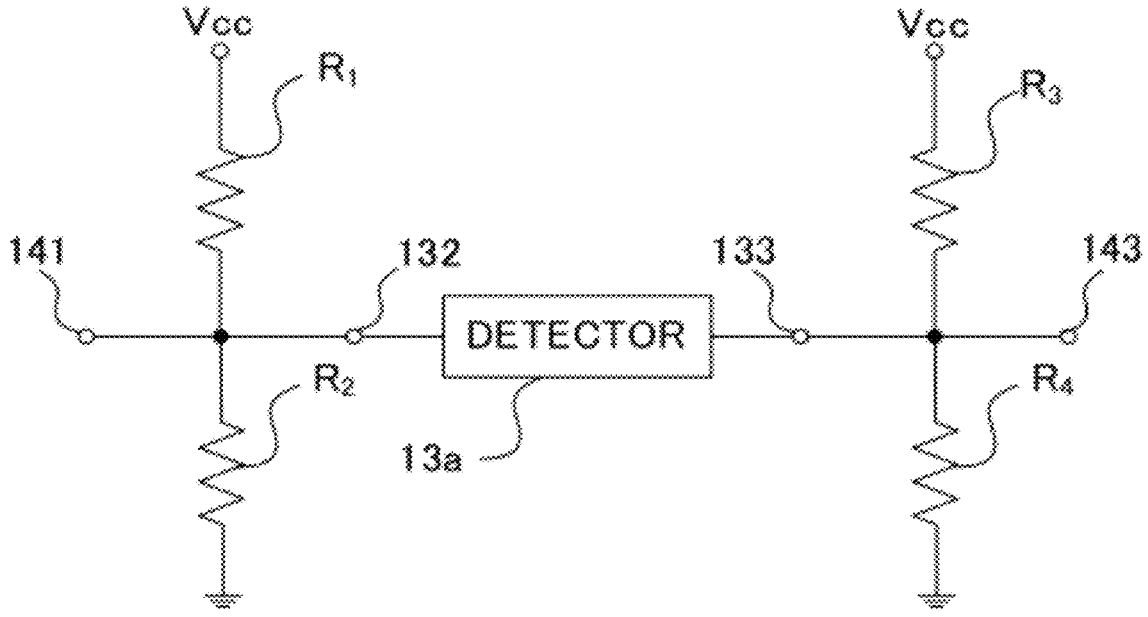
FIG. 5 is a circuit diagram of a printed circuit board in the microphone according to the embodiment.

FIG. 5 shows an example of the circuit diagram of the printed circuit board 13 in the microphone 1 according to the embodiment. A resistor $R_1$ and a resistor $R_2$ are connected in series to each other, and are connected to a supply voltage Vcc and the ground, respectively. Likewise, a resistor $R_3$ and a resistor $R_4$ are connected in series to each other, and are connected to the supply voltage Vcc and the ground, respectively. The resistors $R_1$, $R_2$, $R_3$ and $R_4$ satisfy a relationship of $R_1 \cdot R_4 \neq R_2 \cdot R_3$. The shaft part 141 is connected between the resistors $R_1$ and $R_2$. The bolt part 143 is connected between the resistors $R_3$ and $R_4$. The printed circuit board 13 has a detector 13*a* connected to the first contact 132 and the second contact 133. The detector 13*a* is composed of, for example, a comparator circuit whose non-inverting input terminal is connected with the first contact 132 and whose inverting input terminal is connected with the second contact 133. The comparator is adjusted to output a first voltage when the two input voltages are different and to output a second voltage when the two input voltages are almost equal. Likewise, the detector 13*a* may be composed of an inverter (NOT) circuit. When an input is supplied to one of the first contact 132 and the second contact 133 and the other one serves as a reference potential, the inverter circuit may be adjusted to output different logical values depending on the potential values of the first contact 132 and the second contact 133. Specifically, the inverter circuit may be adjusted to output 1 (or 0) when the two potential values are different and to output 0 (or 1) when the two potential values are almost equal.

Because the resistors $R_1$, $R_2$, $R_3$ and $R_4$ satisfy the relationship of $R_1 \cdot R_4 \neq R_2 \cdot R_3$, with the microphone 1 off-hooked from the hanger hook 2, the shaft part 141 and the bolt part 143 have different potentials with respect to the ground. The detector 13*a* detects that the voltages at the first contact 132 and the second contact 133 are different. Accordingly, it is possible to detect that the microphone 1 is off the hanger hook 2. With the microphone 1 set on the hanger hook 2, the first contact 132 and the second contact 133 are connected to each other. As a result, the detector 13*a* detects that the first contact 132 and the second contact 133 have the same voltage. Accordingly, it is possible to detect that the microphone 1 is hooked on the hanger hook 2. The detector 13*a* sends a signal indicative of the detected state to the body of the communicating apparatus (not shown) from the connector 131 via the cord 3.

The circuit of the printed circuit board 13 is not limited to the example shown in FIG. 5. For example, either the resistor $R_2$ or resistor $R_4$ may have 0Ω, i.e., either the shaft part 141 or the bolt part 143 may be grounded. The circuit of the printed circuit board 13 has only to set the voltages of the shaft part 141 and the bolt part 143 different from each other with the microphone 1 off-hooked from the hanger hook 2, and set the voltages substantially the same with the microphone 1 hooked on the hanger hook 2. The detector 13*a* may be any detector circuit as long as the circuit has an adequate input impedance as compared with the resistors $R_1$, $R_2$, $R_3$ and $R_4$, and can discriminate the different voltage states and the identical voltage state of the first contact 132 and the second contact 133.

The hanger knob 14 is not limited to the shape shown in FIGS. 2A and 4. The bolt part 143 may not have a circular cylindrical shape. For example, referring to FIGS. 2A and 4, the bolt part 143 may have a structure to cover only the lower side of the shaft part 141 so long as the flange portion 144 which is engaged with the hanger hook 2 to be electrically conductive therewith is provided at the distal end of the bolt part 143. Further, the shaft part 141 may not have a columnar shape. The shaft part 141 should be in contact with a part (support spring 24) of the hanger hook 2 to be electrically conductive therewith when the microphone 1 is hooked on the hanger hook 2 with the hanger knob 14.

According to the embodiment, the configuration of the microphone 1 can allow the printed circuit board 13 to detect hooking of the microphone 1 on the hanger hook 2, thus making it possible to eliminate the wiring to the hanger hook 2.

According to the embodiment, hooking of the microphone 1 on the hanger hook 2 can be detected with the structure of the hanger knob 14 alone, eliminating the need for providing the microphone 1 with the hanger plate structure. It is therefore possible to eliminate the troublesome work of processing the hanger plate and attaching the hanger plate to the rear case, and suppress restrictions on the design of the microphone.

According to the embodiment, the hanger switch is comprised only of the hanger hook 2 and the hanger knob 14. The embodiment can be adapted to a conventional microphone without a hanger switch if the hanger knob is modified and the printed circuit board is provided with contacts.

Because the hanger hook 2 need not be provided with a projecting structure for pressing the hanger plate according to the embodiment, the hanger hook is superior to the hanger hook having the projecting structure in appearance and safety.

In addition, the foregoing hardware configuration is illustrative, and can be modified and changed optionally as needed.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A microphone comprising:

a microphone case;

a hanger knob secured to the microphone case; and a conductive hanger hook on which the microphone case is hooked via the hanger knob, the hanger knob having a first conductor portion extending in an extension direction of the hanger knob, and a second conductor portion insulated from the first conductor portion, wherein the hanger hook having a hanger member that is formed with a notch to lock the hanger knob and is in contact with the second conductor portion in a locked state, and an urging member that is in contact with the first conductor portion and urges the hanger knob in a direction of pushing the hanger knob back toward the hanger member, with the hanger knob being locked with the notch.

2. The microphone according to claim 1, wherein the urging member comprises a conductive plate spring.

3. The microphone according to claim 2, wherein a recess is formed at that portion of the first conductor portion which contacts the urging member, and a projecting portion that fits in the recess is formed at the plate spring.

4. The microphone according to claim 1, wherein the second conductor portion comprises:

a through hole formed in a direction of a center axis;

a screw groove formed on one end portion of the second conductor portion which is secured to the microphone case; and a bolt that is screwed into a nut, provided inside the microphone case, to be secured to the microphone case, and the first conductor portion extends inside the through hole through an insulator.

5. The microphone according to claim 2, wherein the second conductor portion comprises:

a through hole formed in a direction of a center axis;

a screw groove formed on one end portion of the second conductor portion which is secured to the microphone case; and a bolt that is screwed into a nut, provided inside the microphone case, to be secured to the microphone case, and the first conductor portion extends inside the through hole through an insulator.

6. The microphone according to claim 3, wherein the second conductor portion comprises:

a through hole formed in a direction of a center axis;

a screw groove formed on one end portion of the second conductor portion which is secured to the microphone case; and a bolt that is screwed into a nut, provided inside the microphone case, to be secured to the microphone case, and the first conductor portion extends inside the through hole through an insulator.

7. The microphone according to claim 1, further comprising:

a printed circuit board provided inside the microphone case;

a first conductive member that provides electrical conduction between the first conductor portion and a first contact on the printed circuit board; and a second conductive member that provides electrical conduction between the second conductor portion and a second contact on the printed circuit board.

8. The microphone according to claim 2, further comprising:

a printed circuit board provided inside the microphone case;

a first conductive member that provides electrical conduction between the first conductor portion and a first contact on the printed circuit board; and a second conductive member that provides electrical conduction between the second conductor portion and a second contact on the printed circuit board.

9. The microphone according to claim 3, further comprising:

a printed circuit board provided inside the microphone case;

a first conductive member that provides electrical conduction between the first conductor portion and a first contact on the printed circuit board; and a second conductive member that provides electrical conduction between the second conductor portion and a second contact on the printed circuit board.

10. The microphone according to claim 4, further comprising:

a printed circuit board provided inside the microphone case;

a first conductive member that provides electrical conduction between the first conductor portion and a first contact on the printed circuit board; and a second conductive member that provides electrical conduction between the second conductor portion and a second contact on the printed circuit board.

11. The microphone according to claim 7, wherein the printed circuit board has a detector that determines whether or not the microphone is hooked on the hanger hook, based on a voltage at the first contact and a voltage at the second contact.

12. The microphone according to claim 10, wherein the printed circuit board has a detector that determines whether or not the microphone is hooked on the hanger hook, based on a voltage at the first contact and a voltage at the second contact.

13. The microphone according to claim 7, wherein the first conductive member comprises a conductive rubber that is insulated from the second conductor portion, has conduction with the first conductor portion, and is disposed at one end of the first conductor portion which faces the printed circuit board, the rubber being in contact with the first contact of the printed circuit board.

14. The microphone according to claim 11, wherein the first conductive member comprises a conductive rubber that is insulated from the second conductor portion, has conduction with the first conductor portion, and is disposed at one end of the first conductor portion which faces the printed circuit board, the rubber being in contact with the first contact of the printed circuit board.

15. The microphone according to claim 7, wherein the second conductive member comprises a conductive plate spring that has one end secured to be conductive with the second conductor portion, and an other end contacting the second contact of the printed circuit board.

16. The microphone according to claim 11, wherein the second conductive member comprises a conductive plate spring that has one end secured to be conductive with the second conductor portion, and an other end contacting the second contact of the printed circuit board.

17. The microphone according to claim 13, wherein the second conductive member comprises a conductive plate spring that has one end secured to be conductive with the second conductor portion, and an other end contacting the second contact of the printed circuit board.

* * * * *